US005990042A

United States Patent [19]

Mochizuki et al.

[11] Patent Number: 5,990,042

[45] Date of Patent: Nov. 23, 1999

[54] SUBLIMATION THERMAL TRANSFER IMAGE RECEIVING MATERIAL AND IMAGE RECORDING METHOD THEREFOR

[75] Inventors: Hidehiro Mochizuki, Numazu; Masanaga Imamura, Fujinomiya, both of Japan

[73] Assignee: Ricoh Company, Ltd., Tokyo, Japan

[21] Appl. No.: 08/975,829

[22] Filed: Nov. 21, 1997

[30] Foreign Application Priority Data

Nov. 21, 1996 [JP] Japan ..... 8-326129
Nov. 20, 1997 [JP] Japan ..... 9-336403

[51] Int. Cl.[6] ..... B41M 5/035; B41M 5/38

[52] U.S. Cl. ..... 503/227; 156/235; 428/195; 428/913; 428/914

[58] Field of Search ..... 8/471; 156/235; 428/195, 913, 914; 503/227

[56] References Cited

U.S. PATENT DOCUMENTS 5,348,931 9/1994 Mochizuki et al. ..... 503/227
5,376,619 12/1994 Mochizuki et al. ..... 503/227
5,525,573 6/1996 Uemura et al. ..... 503/227
5,565,404 10/1996 Mochizuki et al. ..... 503/227
5,658,850 8/1997 Taniguchi et al. ..... 503/227

*Primary Examiner*—Bruce H. Hess
*Attorney, Agent, or Firm*—Cooper & Dunham LLP

[57] ABSTRACT

A noncontact-reading type IC card image receiving material useful for sublimation thermal transfer recording is provided which is made by forming a resin cover film overlying a substrate including an IC chip and an antenna and in which an image is recorded on a surface of the receiving material or a receiving layer optionally formed on the receiving material by imagewise heating a sublimation thermal transfer recording material having an ink layer which contacts the receiving material or the receiving layer, wherein the resin cover film is formed by an injection and compression molding method. The receiving material is preferably subjected to a heat treatment after an image is formed thereon.

32 Claims, No Drawings

SUBLIMATION THERMAL TRANSFER IMAGE RECEIVING MATERIAL AND IMAGE RECORDING METHOD THEREFOR

BACKGROUND OF THE INVENTION

1. Field of the Invention

The present invention relates to a sublimation thermal transfer image receiving material and an image recording method therefor, and more particularly, to a card type sublimation thermal transfer image receiving material having good recording properties and good image qualities and durability of a recorded image, as well as to an image recording method which cost-efficiently produces a good image on such a card type sublimation thermal transfer image receiving material.

2. Discussion of the Related Art

Recently, the demand for full color recording has increased year by year. There have been known various full color recording methods including electrophotographic recording methods, ink jet recording methods and sublimation thermal transfer recording methods. Among these methods, sublimation thermal transfer recording methods are widely employed because of having the following advantages over the other recording methods:

(1) a full color image having excellent image qualities can be obtained;

(2) recording speed is relatively high; and (3) operation and maintenance of the recording apparatus are relatively easy.

In sublimation thermal transfer recording, an image can be obtained on a sublimation thermal transfer image receiving material (referred to as a receiving material) upon application of heat to the back side of a sublimation thermal transfer image recording material (referred to as a recording material) whose ink layer contacts the receiving material. The recording material includes a substrate and an ink layer which is formed on the substrate and includes a thermodiffusional dye (hereinafter referred to as a sublimable dye) dispersed in a binder resin. The recording material may include a heat resistant layer on the back side thereof. The receiving material includes a substrate and optionally an image receiving layer (referred to as a receiving layer) which is formed on the substrate. When heat is applied to the recording material, the sublimable dye diffuses into the receiving material or the receiving layer of the receiving material, so that an image is formed on the receiving material.

Currently, various cards such as credit cards, cash cards, identification cards, cards bearing personal medical data, membership cards or the like are widely used.

Cards are roughly classified as follows:

(1) a card merely made of a resin plate such as polyvinyl chloride, polyester, acrylonitrile-butadiene-styrene copolymer (ABS) or the like and having a print image thereon;

(2) a card having a resin plate and a magnetic stripe which is formed on the resin plate and in which a small amount of information such as a personal identification number is stored; and (3) a card having a resin plate and an IC chip which is mounted on or in the resin plate and which can store a relatively large amount of information compared to the magnetic stripe.

The card having an IC chip (referred to as an IC card) is predicted to be widely used in the future.

Types of IC card include a noncontact-reading type IC card in which an antenna, an IC chip, a coil and the like are mounted in a card, and a contact-reading type IC card in which an IC chip and a coil are mounted on a card and terminals are exposed on the surface of the card.

Currently, there is a tendency to mount a portrait of an owner on these cards to prevent other persons from using the cards. A suitable method for mounting a portrait on a card is a sublimation thermal transfer recording method in which an image can be directly recorded on a card material having a relatively low softening point such as polyvinyl chloride by imagewise heating a recording material, whose ink layer is contacting the surface of the card, using a thermal printhead. The sublimation thermal transfer recording method is widely employed for this application because of having the above-mentioned advantages, and particularly, being a dry image forming process and easily producing an image having excellent image qualities as good as those of a photograph using silver halide. Card materials for the card type receiving material have also been studied in which a receiving layer which can be easily dyed with a sublimable dye is formed on the entire surface or an area of a resin card material which is safer in environmental pollution than polyvinyl chloride.

Methods for making a noncontact-reading type IC card include the following methods:

(1) a resin cover film which is recessed corresponding to the projection of an antenna coil, an IC chip, a condenser and the like which are formed on a resin film substrate is overlaid on the resin film substrate (resin cover film overlaying method); and (2) a resin cover film is formed on a resin film substrate having an antenna coil, an IC chip, a condenser and the like by an injection molding method (resin cover film injection molding method).

An IC card manufactured by the resin cover film overlaying method is expensive because it takes much expense in time to manufacture the IC card. In contrast, an IC card manufactured by the resin cover film injection molding method is not expensive; however, the resultant IC card has a drawback in that the surface of the formed resin cover film is relatively roughened compared to the surface of the IC card manufactured by the resin cover film overlaying method because the IC card manufactured by the injection molding method tends to have camber and/or shrink marks compared to cards having a magnetic stripe which are manufactured by a blanking method.

When an image is recorded on a card having such a rough surface by a sublimation thermal transfer recording method, the recorded image has defects such as white spots, white lines or unevenness of image density. This is because an image cannot be recorded or is unevenly recorded on a recess of the rough surface of the resin cover film. In attempting to solve this problem, when a card is made by an improved injection molding method in which the cooling time after the injection of the resin cover film is prolonged, the resultant card has a smooth surface; however the card is expensive because it takes much expense in time to manufacture the card.

Because of these reasons, a need exists for a noncontact-reading type IC card receiving material on which images having good image qualities can be cost-efficiently recorded by a sublimation thermal transfer recording method.

SUMMARY OF THE INVENTION

Accordingly, one object of the present invention is to provide a noncontact-reading type IC card receiving material on which images having good image qualities can be cost-efficiently recorded by a sublimation thermal transfer image recording method and to provide a sublimation thermal transfer image recording method therefor.

To achieve such an object, the present invention contemplates the provision of a noncontact-reading type IC card receiving material useful for sublimation thermal transfer recording which is made by overlaying a resin cover film on a substrate including an IC chip and an antenna and in which an image is recorded on a surface of the receiving material or a surface of a receiving layer formed on the surface of the receiving material by imagewise heating the back side of a recording material whose ink layer contacts the receiving material or the receiving layer, wherein the resin cover film of the noncontact-reading type IC card receiving material is formed by an injection and compression molding method.

Preferably, the resin cover film includes particulate glass, and a porous intermediate layer is formed between the resin cover film and the receiving layer.

In addition, the receiving layer preferably includes at least one of an antioxidant, a photostabilizer and an ultraviolet absorbing agent.

Further, a protective layer including at least an ultraviolet absorbing agent is preferably formed on the recorded image.

Furthermore, the recorded image is preferably heated directly or via the protective layer.

Furthermore, filtered maximum waviness height of the surface of the IC card receiving material is preferably not greater than about 10 $\mu$m and an amount of camber of the IC card receiving material is preferably not greater than about 1 mm.

In another embodiment of the present invention, a sublimation thermal transfer image recording method is provided in which an image is recorded on a surface of the receiving material or on a surface of a receiving layer formed on the surface of the receiving material by imagewise heating the back side of a recording material whose ink layer contacts the receiving material or the receiving layer while the recording material and the receiving material are feeding at a feeding speed, wherein the feeding speed of the receiving material is greater than the feeding speed of the recording material.

These and other objects, features and advantages of the present invention will become apparent upon consideration of the following description of the preferred embodiments of the present invention.

DESCRIPTION OF THE PREFERRED EMBODIMENTS

In contact-reading type IC cards, an image such as a portrait of a person can be clearly recorded on a surface of the card, avoiding the part of an IC chip and terminals thereon. However, in noncontact-reading type IC cards, since an antenna is formed in almost the entire area of the card, an image cannot be recorded avoiding the area under which the antenna is present. Therefore, a clear image cannot be obtained because the surfaces of the IC cards are roughened and/or cambered particularly when the IC cards have a resin cover film formed by an injection molding method. As aforementioned, when the resin cover film is formed by an injection molding method while a cooling time is prolonged after the injection of a melted resin, the resultant IC cards have a flat and smooth surface but are expensive because of relatively low productivity.

The noncontact-reading type IC card of the present invention generally has a total thickness of from about 760 $\mu$m to about 1 mm. The noncontact-reading type IC card can be manufactured, for example, by the following method:

(1) a circuit and an antenna are printed with silver paste on resin film substrate such as polyester film or the like having thickness of from about 20 to about 500 $\mu$m, and preferably from about 100 to about 250 $\mu$m, and then an IC chip, a condenser and the like are mounted on the film substrate with an adhesive agent to form a main functional part on the film substrate(the circuit and the antenna may be previously formed and mounted on the resin film substrate with an adhesive agent); and (2) a resin cover film is formed on the resin film substrate having the main functional part by "an injection and compression molding method" so that the total thickness of the IC card is in the above-mentioned range.

The injection and compression molding method means a method in which an injection molding method and a compression molding method are combined. In detailed description, the injection and compression molding method includes the following methods:

(1) a melted resin material is injected under low pressure into a cavity of a die which contains a resin film substrate having a main functional part and which is slightly opened or loosely fastened so as to contain an excessive amount of the injected resin material, the die is then closed to compress the melted resin material in the cavity after or during the injection of the melted resin material, and then the die is cooled while compressing the injected resin material to solidify the resin material so that there is no camber or shrink marks on the surface of the formed resin cover film; and (2) a melted resin material is injected into a cavity of a die which contains a resin film substrate having a main functional part and which is fastened, and the injected resin material is cooled while at least one part of the injected resin material is pressed by a cylinder which acts on the inside of the die to exert pressure on the injected resin material to smooth the surface of the resultant resin cover film.

Generally, in printing methods and thermal transfer recording methods, the smoother surface a card receiving material has, the better image qualities an image recorded on the surface has. When an image is recorded on a card material or a receiving layer formed on the card material by the sublimation thermal transfer recording method, the recorded image tends to have more defects such as white spots, white lines and unevenness of image density compared to an image recorded on the same card material by a printing method or a thermofusible thermal transfer recording method. This is because the sublimation thermal transfer recording method transfers only one or more sublimation dyes by diffusing them while the latter two methods transfer liquid ink or melted ink.

Images having good image qualities can be recorded on the card material of the present invention by a sublimation thermal transfer recording method.

As aforementioned, the noncontact-reading type IC card tends to have camber and/or shrink marks. When an image is formed on a recess of a shrink mark of the IC card, the recorded image has white spots, white lines or relatively low image density because an air layer which is a good heat insulator is interjected between a thermal printhead and the IC card. When an image is recorded on an IC card and a general receiving material such as paper or synthetic paper each of which has a recess having the same depth, these undesired images tend to occur more frequently on the IC card compared to the general receiving material. This is because the interjected air layer between the thermal printhead and the general receiving material decreases or disappears by the pressure of the thermal printhead and/or a platen roller, which presses the receiving material towards the thermal printhead, due to good deformability of the general receiving material while the interjected air layer between the thermal printhead and the IC card hardly decreases since the IC card is rigid.

In addition, since the IC card is rigid, if the IC card is cambered, the IC card is not sufficiently flattened by the pressure of the thermal printhead and/or the platen roller and therefore there occurs a problem such that the IC card is skewed during the image recording process, resulting in formation of an incomplete image, or such that an image cannot be recorded because the IC card does not feed.

Further, the IC card tends to have camber and/or shrink marks more frequently compared to a plastic card having the same thickness as the IC card because the IC card includes an IC chip and a coil whose heat conductivity or heat capacity is considerably different from that of the resin material of the IC card. A technic card. A technique for forming a mere plastic card having a thickness of about 1 mm without camber and shrink marks has been established; however, an IC card which is cost-efficiently manufactured without camber and shrink marks has not ever been obtained.

The IC card receiving material of the present invention preferably has smoothness not greater than about 10 $\mu$m in filtered maximum waviness height WCM, more preferably not greater than about 7 $\mu$m, and even more preferably not greater than about 4 $\mu$m. The term "filtered maximum waviness height WCM" means a maximum value of waviness height of a cross-sectional curve of surface of a card when the card is oriented horizontally and is vertically cut. The filtered maximum waviness height is measured by a method based on JIS B 0610, in which waves of the curve whose wave length is less than a predetermined value are eliminated using a phase-compensation-type low-pass filter. The method for measuring the filtered maximum waviness height is described later in detail.

The IC card receiving material of the present invention preferably has camber not greater than about 1 mm, preferably not greater than about 0.5 mm and more preferably not greater than 0.3 mm. The method of measuring the camber is also described later.

Suitable resins for use in the resin cover film include known resins such as polyvinyl chloride resins (PVC), phenolic resins, low density polyethylene resins (LDPE, LLDPE), high density polyethylene resins (HDPE), polypropylene resins (PP), polystyrene resins (PS (GP, HI)), acrylonitrile-butadiene-styrene copolymers (ABS), polyethylene terephthalate resins (PET), polymethyl methacrylate resins, nylon resins, polyacetal resins, polycarbonate resins and the like. Among these resins, ABS and PET are preferable because of having good mechanical strength, good heat resistance and good weather resistance.

The resin cover film preferably includes glass particles. By including the glass particles, which do not deform at a temperature in which the resin softens, in the resin cover film, deformation of the resin cover film can be reduced. The content of the glass particles in the resin cover film is from about 0.1 to about 80% by weight, and preferably from about 5 to about 50% by weight. Suitable particle shapes of the glass particles include spherical, fibriform and indeterminate forms but are not limited thereto. A suitable particle diameter of the glass particles is from about 0.1 $\mu$m to hundreds of micrometers, and preferably from about 1 $\mu$m to tens of micrometers, so as not to cause die trouble and not to roughen the surface of the resin cover film.

Suitable molding pressure in the molding process is from hundreds to thousands of kg/cm$^2$, and preferably from about 300 to about 3000 kg/cm$^2$. The injection time is from about 0.1 second to a couple of minutes, and more preferably from about 1 to about 50 seconds. The temperature of the injected resin (molding temperature) which depends on the material of the resin and in which the resin can flow is from about 100 to about 400° C., and preferably from about 140 to about 300° C. The injection cycle time is from about 1 second to a couple of minutes, and preferably from about 4 to tens of seconds. The die temperature is from about 20 to about 100° C., and preferably from about 30 to about 80° C. The injection cycle time is generally about 1 minute or less, and preferably from about 30 to about 40 seconds for molding a card having a thickness of about 1 mm.

The IC card receiving material of the present invention preferably includes a receiving layer thereon.

Suitable materials for use in the receiving layer include known resins which can be dyed with sublimable dyes. Specific examples of such resins include polyolefin such as polypropylene; halogenated polymers such as polyvinyl chloride and polyvinylidene chloride; vinyl polymers such as polyvinyl acetate and polyacrylates; polyester resins such as polyethylene terephthalate and polybutylene terephthalate; polystyrene resins; polyamide resins; cellulose resins; and polycarbonate resins. Among these resins, vinyl polymers, polycarbonate resins and polyester resins are preferable. When the resin cover film of the IC card receiving material is made of the above-mentioned resins or resin which can be easily dyed with sublimable dyes, the IC card can be used as a receiving material without forming a receiving layer thereon.

The receiving layer may include an auxiliary agent such as modified or unmodified silicone oils; fluorine-containing releasing agents; pigments such as titanium oxide, zinc oxide, calcium carbonate, silica or the like; ultraviolet absorbing agents; and antioxidants.

The thickness of the receiving layer is from about 1 to about 50 $\mu$m, and preferably from about 2 to about 5 $\mu$m.

The receiving layer of the IC card receiving material of the present invention preferably includes at least one of an antioxidant, a photostabilizer and an ultraviolet absorbing agent to prevent the receiving layer and images formed thereon from coloring or fading. The preferred total content of an antioxidant, a photostabilizer and an ultraviolet absorbing agent is about 0.05 to about 30 parts by weight per 100 parts of total weight of resins in the receiving layer. If a protective layer including an ultraviolet absorbing agent, which is mentioned later, is formed on the receiving layer, an ultraviolet absorbing agent is not necessarily included in the receiving layer.

Specific examples of an antioxidant for use in the receiving layer of the IC card receiving material of the present invention include an amine type antioxidant such as, N, N'-diphenyl-1,4-phenylenediamine and phenyl-β-naphthylamine; a phenol type antioxidant such as, 2,6-di-t-butyl-β-cresol, 4, 4'-butylidene-bis(3-methyl-6-butylphenol) and tetrakis{methylene-3-(3', 5'-di-t-butyl-4'-hydroxyphenyl) propionate}; a sulfur-containing antioxidant such as, 2-mercaptobenzothiazole and distearylthiodipropionate;

hydroquinone type antioxidant such as, 2,5-di-t-butylhydroquinone; and guanidine derivatives such as, 1, 3-dicyclohexyl- 2-(2', 5'-dichlorophenyl)guanidine.

Suitable photostabilizers for use in the receiving layer of the receiving material of the present invention include hindered amines and hindered phenols. Tertiary amine type photostabilizers are preferable because they do not react with an isocyanate compound to be used for the receiving layer. Specific examples of the tertiary amine type photostabilizer include Adekastab LA-82 and Adekaarcles DN-44M which are manufactured by ksahi Denka Kogyo K.K. and Sanol LS-765 which is manufactured by Sankyo Co., Ltd.

Suitable ultraviolet absorbing agents for use in the receiving layer of the receiving material of the present invention include known ultraviolet absorbing agents such as, hydroxybenzophenone, dihydroxybenzophenone, benzotriazole, hindered amine and salicylate derivatives. Specific examples of the ultraviolet absorbing agents include Tinuvin P (manufactured by Ciba Geigy Ltd.), 2-hydroxy-4-methoxybenzophenone, 2-hydroxy-4-octoxybenzophenone, 2-(2'-hydroxy -3', 5'-di-t-butylphenyl)-5-chlorobenzotriazole, 2 -(2-hydroxy-3, 5-di-t-butyl-5'-methylphenyl)-5-chlorobenzotriazole and 2-(2'-hydroxy-3'-t-butyl-5'-methylphenyl)-5-chlorobenzotriazole.

The IC card receiving material of the present invention preferably includes an intermediate layer between the resin cover film and the receiving layer. The intermediate layer is preferably porous. The porous intermediate layer can be formed by one or more of the following methods:

(1) a resin including hollow particles is coated on the IC card and dried to form a porous intermediate layer;
(2) a resin including a foaming agent is coated on the IC card, dried and heated to form air bubbles in the resin layer, resulting in formation of a porous intermediate layer;
(3) a resin dissolved in solvents including a solvent which hardly dissolves the resin is coated on the IC card and dried to form a porous intermediate layer; and
(4) a porous resin film including hollow particles or air bubbles therein is adhered to the IC card to form a porous intermediate layer.

Among these porous layers, the porous layer (1) and the porous resin film (4) are preferable because the porous structures of them cannot be destroyed by heat and/or pressure during an image recording process.

Suitable hollow particles for use in the porous intermediate layer include so-called microballoon particles which are made by microencapsulating a liquid having a low boiling point such as butane, pentane or the like with a resin such as polyvinylidene chloride, polyacrylonitrile or the like. When microballoon is heated, the liquid is vaporized and hollow particles are obtained. Microballoon particles which are covered with a white pigment can also be employed. In the intermediate layer of the IC card receiving material of the present invention, microballoon particles which can make hollow particles upon application of relatively low temperature heat treatment are preferable. A variety of microballoon particles can be obtained from Matsumoto Yushi Seiyaku Co., Ltd. The microballoon particles can be used for the intermediate layer before and after hollows are formed. When microballoon particles before hollows are formed are used in the intermediate layer, a porous intermediate layer can be obtained by the above-mentioned method (2).

The volume percentage of hollows in the hollow particles is preferably greater than about 50%, and more preferably greater than about 90%, to maintain good heat insulation efficiency and good cushion properties of the intermediate layer, which results in production of images having good image qualities. The particle diameter of the hollow particles is preferably from about 0.2 to about 20 $\mu$m to maintain good heat insulation efficiency, good cushion properties, and smooth surface of the intermediate layer.

Suitable resins for use in the intermediate layer include water-soluble resins or aqueous emulsions such as polyvinyl alcohol, styrene-butadiene rubber (SBR) and starch; polyamides; epoxy resins; acrylic resins; polyvinyl chloride resins; vinyl chloride-vinyl acetate copolymers; and polyesters.

Thickness of the intermediate layer is from about 1 to about 50 $\mu$m, and preferably from about 3 to about 30 $\mu$m to maintain good heat insulation efficiency, good cushion properties, and good coating properties of the intermediate layer.

The porous resin film for use as the intermediate layer includes but is not limited to:

(1) a porous resin film in which a foaming agent included in a resin film is foamed to obtain a porous resin film; and
(2) a porous resin film such as synthetic paper in which a resin film including an additive is drawn biaxially or uniaxially to form air bubbles therein.

Suitable resins for use in the porous resin film include known resins used for resin films such as polyester resins; polysulfone resins; polystyrene resins; polycarbonate resins; cellophane; polyamide resins; polyimide resins; polyarylate resins; polyethylene naphthalate resins; and polypropylene resins. Among these porous resin films, synthetic paper, foamed polyethylene terephthalate (PET) and foamed polypropylene (PP) are preferable because of having good whiteness, good heat resistance and good stiffness. The thickness of the porous resin film is from about 10 to about 200 $\mu$m, and preferably from about 20 to about 75 $\mu$m to maintain good heat insulation efficiency and good cushion properties of the intermediate layer and to make an IC card having the desired thickness of from about 760 $\mu$m to about 1 mm.

The volume percentage of air bubbles in the porous intermediate layer is a result effective factor to maintain good heat insulation efficiency and good cushion properties of the intermediate layer and to maintain manufacturing cost inexpensive. Therefore, the volume percentage of air bubbles in the porous intermediate layer is preferably controlled so that the ratio (specific gravity of the porous intermediate layer)/(specific gravity of the intermediate layer if the intermediate layer has no air bubble) is not greater than 0.7.

The IC card receiving material of the present invention preferably includes a protective layer.

The protective layer is formed on the image recorded receiving layer to prevent the recorded image and the receiving layer from fading or coloring. The protective layer preferably includes an ultraviolet absorbing agent.

The protective layer is preferably formed, for example, by one of the following methods:

(1) a resin film which includes an ultraviolet absorbing agent and on which, if desired, a layer of metal is formed by evaporation is superimposed on the image recorded receiving material and adhered with an adhesive agent which is thermosensitive or pressure sensitive;
(2) a transferable protective layer including an ultraviolet absorbing agent which is formed on a heat resistant substrate and which, if desired, has a thermosensitive or pressure sensitive adhesive layer thereon is transferred onto the image recorded receiving material by heating the back side of the substrate;
(3) a transferable protective layer including an ultraviolet absorbing agent which is formed on a temporary substrate with a releasing layer therebetween is transferred onto the image recorded receiving layer; or
(4) a transferable protective layer including an ultraviolet absorbing agent which is repeatedly formed on an area adjacent to each of ink layers which are repeatedly formed in a recording material is transferred onto the image recorded receiving layer by heating the back side, i.e., a heat resistant layer side, of the recording material after the image is recorded on the receiving layer using the ink layer of the recording material.

Generally, the protective layer is preferably formed on the image recorded receiving layer before or after the image recorded receiving layer is subjected to the heat treatment. However, the protective layer which is formed by the above-mentioned method (4) is preferably formed on the image recorded receiving layer while the receiving layer is being subjected to the heat treatment.

Suitable resin films for use as the protective layer of the present invention include known resin films which have good resistance to abrasion and chemicals, good transparency and hardness.

Specific examples of such a resin film include polyester, polypropylene, cellophane, polycarbonate, cellulose acetate, polyethylene, polyvinyl acetate, polystyrene, polyamide, aromatic polyamide, polyimide, polysulfone, polyvinylidene chloride, polyvinyl alcohol and fluorine-containing resin films. Among these resin films, a polyethylene terephthalate (PET) film is preferable because of having relatively good heat resistance and small heat shrinkage. The thickness of the protective layer is preferably from about 5 to about 50 μm.

Materials useful for the transferable protective layer of the present invention include resins which have good transparency, do not adhere to the temporary substrate when heated, and are preferably crosslinkable.

Specific examples of such resins include crosslinkable polyurethane resins, crosslinkable polyester resins, acetate resins, silicone resins which are modified by polyester, polystyrene, acrylate and urethane, and resins having relatively low dye receivability which are mentioned later. The resin having relatively low dye receivability which is mentioned later is preferably used for the protective layer to prevent the recorded image from blurring. The thickness of the transferable protective layer is preferably from about 0.1 to about 50 μm.

The film of the protective layer is adhered to the image formed receiving layer via an adhesive layer which is made of a thermosensitive or a pressure sensitive adhesive. Specific examples of the adhesive agents include acrylic resins, polyvinyl chloride resins, vinyl chloride-vinyl acetate resins, polyester resins, polyamide resins, ethylene-acrylate copolymers, ethylene-vinyl acetate resins, polyurethane resins, polymethyl methacrylate and silicone resins which are not modified or are modified by a resin such as polyester, polystyrene, acrylate and urethane. Among these resins, resins having relatively low dye receivability which are mentioned later are preferable for the adhesive agent to prevent the recorded image from blurring. The preferred thickness of the adhesive layer is about 0.1 to about 10 μm.

In addition, the adhesive layer preferably includes at least one of an antioxidant, a photostabilizer and an ultraviolet absorbing agent. Specific examples of the antioxidant, the photostabilizer and the ultraviolet absorbing agent include the materials mentioned in the receiving layer. The preferable content of the antioxidant, the photostabilizer and the ultraviolet absorbing agent in the adhesive layer is almost the same as that in the receiving layer. If a protective layer including an ultraviolet absorbing agent is formed, the adhesive layer does not necessarily include an ultraviolet absorbing agent.

Next, the recording material is described hereinafter.

A recording material for use in combination with the receiving material of the present invention includes a recording material for one-time sublimation thermal transfer recording and a recording material for multiple sublimation thermal transfer recording, each of which includes a substrate and an ink layer including sublimable dye and a binder resin.

A suitable substrate for use in the recording material of the present invention includes any known substrate used in the conventional sublimation thermal transfer recording material. For example, a resin film, such as polyester, polysulfone, polystyrene, polycarbonate, cellophane, polyamide, polyimide, polyarylate and polyethylene naphthalate resin films, which have a thickness of from about 0.5 to about 20 μm and preferably from about 3 to about 10 μm, can preferably be employed.

Suitable sublimable dyes for use in the ink layer of the recording material of the present invention include known sublimable dyes.

Specific examples of such sublimable dyes include but are not limited to:

C.I. Disperse Yellows 1, 3, 8, 9, 16, 41, 54, 60, 77 and 116;
C.I. Disperse Reds 1, 4, 6, 11, 15, 17, 55, 59, 60, 73 and 83;
C.I. Disperse Blues 3, 14, 19, 26, 56, 60, 64, 72, 99 and 108;
C.I. Solvent Yellows 77 and 116;
C.I. Solvent Reds 23, 25 and 27; and
C.I. Solvent Blues 36, 63, 83 and 105.

These Sublimable Dyes are Employed Alone or in Combination.

Suitable binder resins for use in the ink layer of the recording material include thermoplastic resins such as polyvinyl chloride resins, polyamide resins, polycarbonate resins, polystyrene resins, acrylic resins, phenolic resins, polyester resins, epoxy resins, fluorine-containing resins, polyvinyl acetal resins and cellulose resins. These resins are employed alone or in combination. Among these resins, cellulose resins and polyvinyl acetal resins are preferable because of having good solubility to organic solvents used for an ink layer coating liquid and good adhesion to the substrate of the recording material. More preferably, polyvinyl acetal resins such as polyvinyl acetoacetal and polyvinyl butyral are used as a binder resin of the ink layer.

Suitable solvents for use in the ink layer coating liquid which dissolve or disperse the above-mentioned sublimable dye and the binder resin include known solvents such as alcohol type solvents, e.g., methanol, ethanol, isopropyl alcohol, butanol and isobutanol; ketone type solvents such as methyl ethyl ketone, methyl isobutyl ketone and cyclohexanone; aromatic solvents such as toluene and xylene; halogen-containing solvents such as dichloromethane and trichloroethane; dioxane; tetrahydrofuran; formamide; dimethylformamide; dimethylsulfoxide. These solvents are employed alone or in combination. The solvents for use in the ink layer coating liquid are generally selected so as to dissolve the sublimable dye and the binder resin employed for the ink layer in a high solid content. Toluene and methyl ethyl ketone are preferable because of having good evaporation speed and good ability to dissolve binder resins and the sublimable dyes, and being relatively inexpensive.

The ink layer preferably includes two layers therein. By having a double-ink-layer construction in which the dye concentration and/or the dye diffusing coefficient of the lower ink layer are greater than those of the upper ink layer, the recording material has good preservability and high sensitivity as a recording material for one-time sublimation thermal transfer recording, and the recording material has good image qualities when used as a recording material for multiple sublimation thermal transfer recording. One-time sublimation thermal transfer recording (referred to as one-time recording) is that an image is formed on a receiving material by imagewise heating the back side of a recording material whose ink layer contacts the receiving material while the recording material is fed at the same speed as that of the recording material. The used recording material is disposed after the recording material is used only once.

Multiple sublimation thermal transfer recording (referred to as multiple recording) includes:

(1) a recording method in which an image is formed on a receiving material using a one-time recording method but the recording material is repeatedly used n-times (referred to as an n-time mode multiple recording method); and (2) a recording method in which an image is formed on a receiving material while the recording material is fed at a speed of 1/n that of the receiving material (referred to as an n-fold speed mode multiple recording method).

The image recorded by the n-fold speed mode multiple recording method is superior to the image recorded by the n-time mode multiple recording method because of advantages such as satisfactory evenness of the recorded image and no wrinkling of the recording material during the image recording process.

The content of the sublimable dye in the upper ink layer is generally less than about 80%, and preferably from 0 to about 60% by weight. The sublimable dye is preferably dispersed in a monomolecular state in the upper ink layer to maintain good evenness of the recorded images and high thermosensitivity.

The thickness of the upper ink layer is from about 0.05 to about 5 $\mu$m, and preferably from about 0.1 to about 2 $\mu$m.

The content of the sublimable dye in the lower ink layer, which depends on whether the recording material is applied for one-time recording or multiple recording, is generally less than about 80%, and preferably less than about 70% by weight n the lower ink layer of the recording material for one-time recording. In the recording material for one-time recording, the dye content ratio, Q, of the content of the sublimable dye in the lower ink layer to the content of the sublimable dye in the upper ink layer is greater than 1 and not greater than 5, and preferably greater than 1 and not greater than 3. The sublimable dye is preferably dispersed in a monomolecular state in the lower ink layer of the recording material for one-time recording to maintain good evenness of the recorded images and high sensitivity. The thickness of the lower ink layer of the recording material for one-time recording is generally from about 0.05 to about 5 $\mu$m, and preferably from about 0.1 to about 2 $\mu$m.

In the recording material for multiple recording, the content of the sublimable dye in the lower ink layer is generally less than about 90%, and preferably less than 86%. The dye content ratio, Q, is generally greater than 1 and not greater than 10, and preferably not less than 1.5 and not greater than 5 to maintain good image qualities in large-n-fold speed mode multiple recording. The sublimable dye is preferably dispersed in the lower ink layer in a state, in which monomolecular dyes and particulate dyes are mixed, to keep tint of the recorded images constant and to maintain good image qualities without unevenness even in large-n-fold speed mode multiple recording. The thickness of the lower ink layer of the recording material for multiple recording is generally from about 0.1 to about 20 $\mu$m, and preferably from about 0.5 to about 10 $\mu$m.

In order to obtain a large diffusion coefficient in the lower ink layer, a resin or a wax which has a relatively low softening point and/or a relatively low glass transition temperature is preferably included in the lower ink layer in an amount of from about 1 to about 90% by weight of the binder resin in the lower ink layer.

Next, the n-fold speed mode multiple recording method useful for recording good images on the IC card image receiving material of the present invention is described hereinafter.

In the n-fold speed mode multiple recording method, since the recording material is fed at a speed of 1/n (n>1) that of the receiving material, i.e., since an image can be recorded with a recording material whose length is 1/n that of the image, a full color image can be obtained at a relatively inexpensive running cost compared to that of the image recorded by a one-time recording method.

When a recording material and a receiving material used for one-time recording or n-time mode multiple recording are used for n-fold speed mode multiple recording, the following problem tends to occur:

(1) the recording material and the receiving material perfectly adhere to each other by the heat for recording images, resulting in occurrence of transfer of the ink layer to the receiving material; or (2) the recording material and the receiving material adhere to each other for a moment, resulting in occurrence of an undesirable horizontal white line in a recorded image.

The recording material useful for n-fold speed mode multiple recording is described hereinafter.

The ink layer of the recording material for use in n-fold speed mode multiple recording preferably includes a lower ink layer (referred to as a dye supplying layer) and an upper ink layer (referred to as a dye transferring layer). The dye supplying layer preferably includes precipitated sublimable dye particles to obtain good evenness of the image density of the recorded images. The precipitated particles mean sublimable dye particles which are precipitated out of a coated dye supplying layer coating liquid including a binder resin, a sublimable dye and a solvent during a drying step. Therefore, the amount and the particle size of the precipitated dye particles change mainly depending on the used solvent. Presence of the sublimable dye particles in a dye supplying layer can be easily observed by an electron microscope. The particle size of the sublimable dye particle (which depends on the thickness of the dye supplying layer) is about 0.01 to about 20 $\mu$m, and preferably from about 1 to about 5 $\mu$m. Since the sublimable dye in the ink layer is particulate, such a problem as crystallization of the sublimable dye during preservation of the recording material does not occur.

To form an ink layer including sublimable dye particles, a solvent which dissolves the sublimable dye particles as little as possible is preferably included in the ink layer coating liquid. Specific examples of such a solvent include alcohol type solvents and solvents including a hydroxide group such as glycol ethers.

In addition, the ink layer preferably includes an upper layer, i.e., a dye transferring layer, disclosed in Japanese Laid-Open Patent Publication No. 5-64980, which is formed on the dye supplying layer.

The dye transferability of the dye transferring layer is preferably less than that of the dye supplying layer. Comparison of dye transferability is carried out by the following methods:

(1) both of a dye supplying layer coating liquid and a dye transferring layer coating liquid are coated on a respective sheet made of the same substrate and dried to form two sheets of single-ink-layer type recording materials so that each coating weight of the dye supplying layer and the dye transferring layer is the same;

(2) each of the prepared recording materials is superimposed on a respective sheet of the same receiving materials so that the coated surface of each recording material contacts the receiving layer of the receiving material, and heat is applied from the back side of each recording material, namely, heat is applied from the side of the substrate opposed to the ink layer, to record an image on the receiving layer; and (3) the image density of each recorded image is measured, and the recording material having the higher image density has higher dye transferability.

According to our investigation, the quantity of a diffused dye in an ink layer can be represented by the following Fick's law:

$$dn=-D\cdot(dc/dx)\cdot q\cdot dt$$

wherein dn represents a quantity of a diffused dye for a time of dt, q represents a cross section into which the dye diffuses, (dc/dx) represents a gradient of the diffused dye concentration, and D represents an average diffusion coefficient in the ink layer when heat is applied.

It will be understood from the above-mentioned equation that the ways to effectively supply a dye from a dye supplying layer to a dye transferring layer are as follows:

(1) the dye concentration in the dye supplying layer is higher than that in the dye transferring layer; and/or (2) the diffusion coefficient of the dye supplying layer is greater than that of the dye transferring layer.

Suitable binder resins for use in the dye transferring layer include known thermoplastic resins and thermosetting resins. Specific examples of such resins include polyvinyl chloride resins, polyvinyl acetate resins, polyamide resins, polyethylene resins, polycarbonate resins, polypropylene resins, acrylic resins, polyester resins, polyurethane resins, epoxy resins, silicone resins, fluorine-containing resins, polyvinyl acetal resins, polyvinyl alcohol resins, cellulose resins, natural thereof synthetic rubbers and copolymers thereof. These resins are employed alone or in combination.

In order to make the dye transferring layer strongly adhere to the dye supplying layer, the dye transferring layer preferably includes a binder resin which has good compatibility with the binder resin in the dye supplying layer. More preferably, the dye transferring layer preferably includes a binder resin which is the same type of resin as the binder resin included in the dye supplying layer.

When the binder resin in the dye transferring layer has active hydrogen, the binder resin can be reacted with an isocyanate compound to make the dye transferring layer more resistant to heat, and thereby an image having good evenness can be obtained without sticking to a thermal printhead.

Specific examples of such an isocyanate compound include aromatic isocyanate compounds such as tolylene diisocyanate, 4, 4-diphenylmethane diisocyanate, triphenylmethane triisocyanate, adducts of tolylene diisocyanate and trimethylolpropane, and trimer of tolylene diisocyanate; aliphatic isocyanate compounds or alicyclic isocyanate compounds such as hexamethylene diisocyanate, dicyclohexylmethane diisocyanate, isophorone diisocyanate, trimethylhexamethylene diisocyanate, 1, 6, 11-undecane triisocyanate, lysine diisocyanate, lysine ester triisocyanate, 1, 8-diisocyanate-4-isocyanatemethyloctane, 1, 3, 6-hexamethylene triisocyanate, bicycloheptane triisocyanate; and derivatives or modified compounds of these compounds.

Specific examples of the preferable isocyanate compounds include Takenate D-102, D-103, D-104, D-103H, D-104N, D-106N, D-110N, D-120N, D-202, D-204, D-215, D-217, D-212M6, D-165NCX, D-170N, D-181N, Staphyloid TDH103, 113 and 703 which are manufactured by Takeda Chemical Industries Inc.

An isocyanate compound and a binder resin are preferably fixed so that the molar ratio of isocyanate groups included in the isocyanate compound to active hydrogen included in the resin is from about 0.1/1 to about 10/1, and more preferably from about 0.3/1 to about 0.7/1.

In addition, the isocyanate compound preferably has a small reaction rate in a reaction with the binder resin to obtain a dye transferring layer coating liquid having a long pot life, particularly when an aliphatic isocyanate is used for a dye transferring layer coating liquid including an alcohol solvent.

The ink layer preferably includes a resin layer having relatively low dye receivability on the top of the ink layer to avoid occurrence of a ghost image when two or more color images are recorded one by one on the same area of the receiving material to obtain a full color image. Suitable resins (for use in the resin layer) having relatively low dye receivability include aromatic polyester resins, styrene-butadiene copolymers, polyvinyl acetate resins and polyamide resins, and preferably include methacrylic resins or copolymers thereof, styrene-maleic acid ester copolymers, polyimide resins, silicone resins, styrene-acrylonitrile copolymers and polysulfone resins. The thickness of the resin layer having relatively low dye receivability is about equal to that of the dye transferring layer. The resin layer having relatively low dye receivability, the dye transferring layer and the dye supplying layer may include known additives such as releasing agents, antioxidants or the like.

Dye receivability of a resin is measured as follows:

(1) preparing a coating liquid by mixing a resin solution having a solid content of 5 to 20% by weight and a silicone oil which is a mixture of SF8417 and SF8411 (both of which are manufactured by Toray Silicone Industries Inc.) mixed in a ratio of 1/1 so that the ratio of the silicone oil to the solid of the resin is 0.3;

(2) coating the coating liquid on a sheet of synthetic paper, Yupo FPG#95 manufactured by Oji Yuka Synthetic Paper Co., Ltd., and drying the coated liquid for 1 minute to form a receiving layer so that the thickness of the receiving layer is 10 $\mu$m on a dry basis;

(3) aging the thus obtained receiving material at room temperature for more than 1 day;

(4) superimposing a cyan colored recording material, e.g., Ck2LB used for Mitsubishi Color Video Copy Processor, on the receiving layer of the receiving material and recording an image on the receiving layer by imagewise heating the back side of the recording material using a thermal printhead, e.g., KMT-85-6MPD4 (manufactured by Kyocera Corp.), having a dot density of 6dots/mm and an average electric resistance of 542 Ω, under a condition of applied energy of 2.00 mJ/dot; and (5) measuring the image density of the recorded image with a Macbeth reflection densitometer RD-918.

A resin whose image density is lower than 1.2 is defined as a resin having relatively low dye receivability in the present invention The recording material may include a heat resistant layer, which is formed on the side opposite to the side of the ink layer, to prevent the recording material from sticking to a thermal printhead.

The receiving material of the present invention useful for the n-fold speed mode multiple recording preferably has resistance to sticking. The receiving layer of the receiving material preferably has a degree of gelation of from about 70 to about 99%, and more preferably from about 90 to about 99%, to maintain good resistance to sticking and good thermosensitivity of the receiving material.

The degree of gelation in the present invention is measured and defined as follows:

(1) measuring the coating weight of the receiving layer when the receiving layer is formed;

(2) cutting a sheet of the receiving material 50 mm wide and 100 mm long, and measuring the weight of the sheet;

(3) dipping the sheet into 500 g of the methyl ethyl ketone (or a good solvent for the binder resin in the receiving layer) for ten minutes;

(4) pulling up the sheet from the methyl ethyl ketone and measuring the weight of the sheet after drying the solvent included in the sheet; and (5) obtaining the degree of gelation by the following equation: (degree of gelation)={1 -(weight difference between the sheet before dipping and after dipping)/(coating weight of the receiving layer of 50 mm wide and 100 mm long)} ×100 (%).

Suitable resins for use in the receiving layer of the receiving material of the present invention include known resins which have active hydrogen and can react with an isocyanate compound to form a crosslinked reaction product.

Specific examples of such resins include polyamide, polyethylene, polypropylene, acrylic resins, polyester resins, vinyl chloride-vinyl acetate copolymers, polycarbonate resins, polyurethane resins, epoxy resins, silicone resins, melamine resins, natural rubber, synthetic rubbers, polyvinyl alcohol resins, and cellulose resins. These resins can be employed individually or in combination. In addition, copolymers of these resins can also be employed.

Among these resins, polyester resins and vinyl chloride-vinyl acetate copolymers are preferable because these resins have good dye receivability and can easily produce a crosslinked resin having a proper degree of gelation by reacting with an isocyanate compound in the presence of a catalyst. Specific examples of the polyester resins include Vylon 200, Vylon 300, Vylon 500, GV-110, GV-230, UR-1200, UR-2300, EP-1012, EP-1032, DW-250H, DX-750H and DY-150H, which are manufactured by Toyobo Co., Ltd. Specific examples of the vinyl chloride-vinyl acetate copolymers include VYHH, VYNS, VYHD, VYLF, VMCH, VMCC, VAGH and VROH, which are manufactured by Union Carbide Corp., and Denka Vinyl #1000A, 1000MT, 1000D , 1000L, 1000CK2 and 1000GKT, which are manufactured by Denki Kagaku Kogyo K. K.

Suitable isocyanate compounds for use in the receiving layer include the isocyanate compounds described above in the ink layer. The molar ratio of the isocyanate groups in the isocyanate compound included in the receiving layer to hydroxide groups in the resin included in the receiving layer is about 0.1/1 to about 1/1.

In formation of a receiving layer of the present invention, it is preferable to age the receiving layer for a long period of time at a high temperature after the receiving layer is coated and dried so that the degree of gelation of the receiving layer is about 70 to about 99%. The preferred aging temperature is about 50 to about 150° C., and more preferably about 60 to about 100° C. to prevent the receiving material from coloring and curling.

A suitable catalyst for use in the receiving layer of the receiving material of the present invention includes an amine type catalyst such as, dimethylmethanolamine, diethylcyclohexylamine, triethylamine, N,N-dimethylpiperazine and triethylenediamine; and a metal-containing catalyst such as, cobalt naphthenate, lead octenate, dibutyl tin dilaurate, stannous chloride, stannic chloride, tetra-n-butyl tin, tri-n-butyl tin acetate, di-n-butyl tin oxide and di-n-octyl tin oxide. Among these catalysts, tin-containing compounds are preferable for use in the receiving layer of the receiving material of the present invention. Specific examples of the tin-containing compounds are TK1L which is manufactured by Takeda Chemical Industries Inc., or Scat1, Scat1L, Scat8, Scat10, Scat71L and StannBL, which are manufactured by Sankyo Organic Synthesis Co., Ltd. To obtain good heat resistance and good thermosensitivity, the preferred content of the catalyst in the receiving layer is from about 0.05 to about 1.3% by weight.

The receiving material on which an image is recorded and, if desired, a protective layer is superimposed thereon is preferably subjected to heat treatment. By subjecting the image recorded receiving material to the heat treatment, a sublimated dye of the image which is present on the surface of the receiving layer can be diffused into the receiving layer, resulting in prevention of the diffused dye from contacting oxygen, i.e., active oxygen, and thereby an image having good resistance to light can be obtained. The preferred temperature of the heat treatment is from about 50 to about 400° C., and more preferably from about 80 to about 200° C. to maintain good image qualities without blurring and to avoid deformation of the substrate of the receiving material and occurrence of a malfunction of an IC chip included in the receiving material. The preferred heating time of the heat treatment is from about 0.1 to about 30 seconds, and more preferably from about 0.1 to about 5 seconds.

The heat treatment is performed before, after or during the formation of the protective layer, depending on the usage of the image recorded receiving material and the structure of the recording apparatus.

Suitable heating devices useful for the heat treatment include known heating devices. Among these heating devices, a thermal printhead, a heat roller or a ceramic heater is preferable because of being able to rapidly raise the temperature thereof to the desired temperature when required.

Up to this point, there has been described the recording method using a thermal printhead as a heating device. However, other sublimation thermal transfer recording methods using heating devices such as a heat roller, a heat plate or laser, or sublimation thermal transfer recording methods using Joule heat generated in a recording material can be used. Among these methods, an electrosensitive thermal transfer recording method which has been disclosed, for example, in U.S. Pat. No. 4,103,066 and Japanese Laid-Open Patent Publications No. 57-14060, 57-11080 and 59-9096 is well known.

The electrosensitive thermal transfer recording material useful for the electrosensitive thermal transfer recording method in the present invention is manufactured by, for example, the following methods:

(1) forming a semiconductive layer on a substrate which includes a heat resistant resin such as, polyester, polycarbonate, triacetyl cellulose, nylon, polyimide and aromatic polyamide, and powder of a metal such as, aluminum, copper, iron, tin, nickel, molybdenum and silver which is dispersed in the heat resistant resin, and forming an ink layer including a sublimable dye on the semiconductive layer; or (2) forming a semiconductive layer including powder of the above-mentioned metal described in method (1) on a substrate by an evaporation or a sputtering method and forming an ink layer including a sublimable dye on the semiconductive layer.

The thickness of the substrate is preferably about 2 to about 15 $\mu$m in consideration of heat conductive efficiency.

When a laser is used for the heating device of the recording method, a recording material including a substrate which can absorb laser light to generate heat is employed. For example, a recording material having a substrate including carbon or having a laser light absorbing layer which is formed on at least one side of the substrate is preferably employed.

Having generally described this invention, a further understanding can be obtained by reference to certain specific examples which are provided herein for purposes of illustration only and are not intended to be limiting. In the descriptions in the following examples, numbers represent weight ratios in parts, unless otherwise specified.

EXAMPLES 1-1 Preparation of Receiving Layer for one-time Recording

The following receiving layer coating liquid (1) for one-time recording was prepared, coated on each noncontact-reading type IC card of Examples 1, 2, 3, 4 and 9 and Comparative Example 1, and dried to prepare a receiving material having a receiving layer 6 μm thick.

Formulation of Receiving Layer Coating Liquid (1)

| | |
|---|---|
| vinyl chloride-vinyl acetate-vinyl alcohol copolymer (VAGH, manufactured by Union Carbide Corp.) | 15 |
| alcohol modified silicone oil (SF8427, manufactured by Toray Silicone Industries, Inc.) | 1 |
| toluene | 40 |
| methyl ethyl ketone | 40 |

1-2 Preparation of Receiving Layer for n-fold Speed Mode Multiple Recording

The following receiving layer coating liquid (2) for n-fold speed mode multiple recording was prepared, coated on each noncontact-reading type IC card of Examples 5, 6, 7, 8, 10 and 11 and Comparative Example 2, and dried to prepare a receiving material having a receiving layer 6 μm thick. The receiving material was subjected to heat treatment for 50 hours at 60° C.

Formulation of Receiving Layer Coating Liquid (2)

| | |
|---|---|
| vinyl chloride-vinyl acetate-vinyl alcohol copolymer (VAGH, manufactured by Union Carbide Corp.) | 15 |
| adduct of isophorone diisocyanate (D-140N, manufactured by Takeda Chemical Industries, Ltd.) | 15 |
| catalyst including tin (TK-1L, manufactured by Takeda Chemical Industries, Ltd.) | 0.1 |
| unmodified silicone oil (SH200 having kinetic viscosity of 1000 cs, manufactured by Toray Silicone Industries, Inc.) | 0.5 |
| alcohol modified silicone oil (SF8427, manufactured by Toray Silicone Industries, Inc.) | 0.5 |
| toluene | 40 |
| methyl ethyl ketone | 40 |

1-3 Preparation of Recording Material for one-time Recording

The following ink layer coating liquid (1) was prepared, and coated on one side of a polyethylene terephthalate (PET) film having a thickness of 6 μm, on whose back side a heat resistant layer having a thickness of 1 μm had been formed, and dried for 90 seconds at 100° C. to form an ink layer having a thickness of 1.2 μm. Thus, a recording material for one-time recording was obtained.

Formulation of ink Layer Coating Liquid (1)

| | |
|---|---|
| Sublimable dye (Kayaset Blue 714, manufactured by Nippon Kayaku Co., Ltd.) | 5 |
| polyvinyl butyral resin (BX-1, manufactured by Sekisui Chemical Co., Ltd.) | 5 |
| toluene | 45 |
| methyl ethyl ketone | 45 |

1-4 Preparation of Recording Material for n-fold Speed Mode Multiple Recording

The following intermediate adhesive layer coating liquid was coated with a wire bar on a non-layered surface of an aromatic polyamide film 6 μm thick having a heat resistant layer 1 μm thick including a silicone resin, dried for 90 seconds at 100° C. and aged for 12 hours at 60° C. to form an intermediate adhesive layer having a thickness of 1 μm. Then a dye supplying layer was coated on the intermediate layer in a thickness of 4.5 μm on a dry basis, further thereon a dye transferring layer was coated in a thickness of 0.5 μm on a dry basis and still further thereon a resin layer having relatively low dye receivability was coated in a thickness of 0.7 μm on a dry basis. Each coated layer was dried for 90 seconds at 100° C. and aged for 12 hours at 60° C. after each coating. Thus a recording material was obtained.

Formulation of Intermediate Adhesive Layer Coating Liquid

| | |
|---|---|
| polyvinyl butyral resin (BX-1, manufactured by Sekisui Chemical Co., Ltd.) | 10 |
| isocyanate compound (Colonate L, manufactured by Nippon Polyurethane Industry Co., Ltd.) | 5 |
| toluene | 95 |
| methyl ethyl ketone | 95 |

Formulation of Dye Supplying Layer Coating Liquid

| | |
|---|---|
| polyvinyl butyral resin (BX-1, manufactured by Sekisui Chemical Co., Ltd.) | 10 |
| sublimable dye (Kayaset Blue 714, manufactured by Nippon Kayaku Co., Ltd.) | 30 |
| ethanol | 180 |
| n-butanol | 10 |

Formulation of Dye Transferring Layer Coating Liquid

| | |
|---|---|
| polyvinyl butyral resin (BX-1, manufactured by Sekisui Chemical Co., Ltd.) | 10 |
| isocyanate compound (Colonate L, manufactured by Nippon Polyurethane Industry Co., Ltd.) | 5 |
| ethanol | 180 |
| n-butanol | 10 |

Formulation of Coating Liquid of Resin Layer having relatively low dye Receivability

| | |
|---|---|
| styrene-maleic acid copolymer (Suprapal AP-30, manufactured by BASF Ltd.) | 5 |
| liquid A | 20 |
| n-butanol | 20 |

The liquid A was prepared by dissolving 15 g of dimethyl methoxy silane and 9 g of methyl trimethoxy silane in a mixture of 12 g of toluene and 12 g of methyl ethyl ketone, and then hydrolyzing for 3 hours after 13 ml of 3% sulfuric acid was added in the mixture thereof.

1-5 Recording Method

Each recording material was superimposed on the respective receiving material so that the ink layer of the recording material contacts the receiving layer of the receiving material. Heat was then applied with a thermal printhead from the heat resistant layer side of the recording material to form an image on the receiving layer of the receiving material. The recording conditions are as follows:

| | |
|---|---|
| dot density of edge-type thermal printhead | 6 dots/mm |
| applied electric power | 0.16 W/dot (for multiple recording) 0.12 W/dot (for one-time recording) |
| feeding speed of receiving material | 8.4 mm/sec. |
| feeding speed of recording material | 0.6 mm/sec. (for multiple recording) 8.4 mm/sec. (for one-time recording) |

Example 1

Formation of Noncontact-reading Type IC card Receiving Material

Electric components including a circuit, an IC, an antenna and the like were provided on a polyester film having a thickness of 125 μm, and a polyvinyl chloride resin cover film was then formed thereon by an injection and compression molding method to obtain an IC card having a thickness of 760 μm and a dimension of 85.6 mm wide and 54 mm long. The die temperature was 50° C., the molding temperature was 160° C., the molding pressure was 1000 kg/cm$^2$ and the injection cycle time was 35 seconds.

The receiving layer for one-time recording was formed on the molded polyvinyl chloride resin film of the previously prepared IC card to obtain an IC card receiving material of the present invention.

Recording Method

Half tone images of 75 mm wide and 44mm long were recorded on the receiving material in combination with the recording material for one-time recording.

Thus a noncontact-reading type IC card receiving material according to the present invention on which the half tone images were recorded by the one-time recording method was obtained.

Example 2

Formation of Noncontact-reading Type IC Card Receiving Material

The procedure for preparation of the IC card in Example 1 was repeated except that the polyvinyl chloride resin cover film was replaced with an acrylonitrile-styrene-butadiene (ABS) resin cover film and the conditions of the molding process were changed as follows:

the die temperature was 55° C.; the molding temperature was 230° C; the molding pressure was 1300 kg/cm$^2$; and the injection cycle time was 30 seconds.

Formation of Receiving Material

The receiving layer for one-time recording was formed on the molded ABS resin cover film of the previously prepared IC card to obtain an IC card receiving material.

Recording Method

The procedure for recording the image in Example 1 was also repeated.

Thus a noncontact-reading type IC card receiving material according to the present invention on which the half tone images were recorded by the one-time recording method was obtained.

Example 3

Formation of Noncontact-reading Type IC card Receiving Material

The procedure for preparation of the IC card receiving material in Example 2 was repeated except that the molded ABS resin cover film included glass particles in an amount of 20% therein, and the die temperature was 60° C., the molding temperature was 250° C. and the molding pressure was 2000 kg/cm$^2$.

Recording Method

The procedure for recording the image in Example 1 was also repeated.

Thus a noncontact-reading type IC card receiving material according to the present invention on which the half tone images were recorded by the one-time recording method was obtained.

Example 4

Formation of Noncontact-reading Type IC Card Receiving Material

The procedure for preparation of the IC card receiving material in Example 2 was repeated except that a porous intermediate layer was formed between the molded ABS resin cover film and the receiving layer.

The formulation of the porous intermediate layer coating liquid was as follows and the porous intermediate layer coating liquid was coated on the IC card with a wire bar and dried for 1 minute at 80° C. to form a porous intermediate layer 20 μm thick.

Formulation of porous intermediate layer coating liquid

| | |
|---|---|
| polyester resin (Vylon 200, manufactured by Toyobo Co., Ltd.) | 10 |
| hollow particle (Matsumoto Microsphere F-81GS, manufactured by Matsumoto Yushi Seiyaku Co., Ltd.) | 10 |
| toluene | 25 |
| methyl ethyl ketone | 65 |

Recording Method

The procedure for recording the image in Example 1 was also repeated.

Thus a noncontact-reading type IC card receiving material on which the half tone image were recorded by the one-time recording method was obtained.

Example 5

Formation of Noncontact-reading Type IC Card Receiving Material

The procedure for preparation of the IC card in Example 2 was repeated. An adhesive layer having a thickness of 3 μm was formed on the molded ABS resin cover film of the previously prepared IC card, and then a foamed polyethylene terephthalate film having a thickness of 50 μm (Crysper #50, (specific gravity of the foamed film)/ (specific gravity of the foamed film if the film has no air bubble)=0.79, manufactured by Toyobo Co., Ltd.) as laminated on the adhesive layer to form a porous intermediate layer.

The receiving layer for n-fold speed mode multiple recording was formed on the porous intermediate layer to obtain an IC card receiving material of the present invention for n-fold speed mode multiple recording.

Recording method:

Half tone images of 75 mm wide and 44 mm long were recorded on the receiving material in combination with the recording material for n-fold speed mode multiple recording.

Thus a noncontact-reading type IC card receiving material according to the present invention on which the half tone images were recorded by the n-fold speed mode multiple recording method was obtained.

Example 6

The procedures for preparation of the IC card receiving material and for recording of the images in Example 5 were repeated except that the foamed polyethylene terephthalate film of the porous intermediate layer was replaced with a foamed polyethylene terephthalate film having a thickness of 50 μm (E60#50, (specific gravity of the porous film)/(specific gravity of the porous film if the film has no air bubble)=0.62, manufactured by Toray Industries Inc.).

Thus a noncontact-reading type receiving material according to the present invention on which the half tone images were recorded by the n-fold speed mode multiple recording method was obtained.

Example 7

The procedures for preparation of the receiving material and for recording of the image in Example 6 were repeated except that a hindered amine type photostabilizer (Sanol LS-765, manufactured by Sankyo Co.) was added to the receiving layer coating liquid (2) in an amount of 1.0 parts by weight.

Thus a noncontact-reading type IC card receiving material on which the half tone images were recorded by the n-fold speed mode recording method was obtained.

Example 8

The procedures for preparation of the receiving material and for recording of the images in Example 6 were repeated except that a polyethylene terephthalate film including an ultraviolet absorbing agent (HB50, manufactured by Teijin Ltd.) was laminated on the image recorded receiving material via an acrylic adhesive agent (Olivine BPS4627-6, manufactured by Toyo Ink Mfg. Co., Ltd.).

Thus a noncontact-reading type IC card receiving material on which the half tone images were recorded by the n-fold speed mode recording method and in which the recorded images were covered with a protective layer was obtained.

Example 9

The procedures for preparation of the receiving material and for recording of the images in Example 3 were repeated except that a protective layer was formed on the image recorded receiving material in combination with a thermal transfer recording material for forming a protective layer by a thermal transfer recording method using a thermal printhead. Formation of thermal transfer recording material for forming protective layer:

The following protective layer coating liquid was coated on a non-layered surface of a polyethylene terephthalate film 6 μm thick which has a heat resistant layer having a thickness of 1 μm on one side thereof, and dried for 90 seconds at 100° C. to form a thermal transfer recording material having a layer 2 μm thick to be transferred as a protective layer on the image recorded receiving material.

Formation of Protective Layer Coating Liquid

| | |
|---|---|
| methyl methacrylate-styrene copolymer | 5 |
| ultraviolet absorbing agent (SANDVOR VSU, manufactured Sandoz Ltd.) | 0.5 |
| toluene | 45 |
| methyl ethyl ketone | 45 |

Thus a noncontact-reading type IC card receiving material on which the half tone images were recorded by the one-time recording method and in which the recorded images were covered with a protective layer was obtained.

Example 10

The procedures for preparation of the IC card receiving material and for recording of the images in Example 6 were repeated except that a polyethylene terephthalate film including an ultraviolet absorbing agent (HB50, manufactured by Teijin Ltd.) was laminated on the image recorded receiving material via a silicone adhesive agent (SD4580, manufactured by Dow Corning Toray Silicone Co., Ltd.).

Thus a noncontact-reading type IC card receiving material on which the half tone images were recorded by the n-fold speed mode recording method and in which the recorded images were covered with a protective layer was obtained.

Example 11

The image recorded IC card receiving material obtained in Example 10 which was covered with the protective layer was subjected to heat treatment from the protective layer side using a heat roller whose temperature was 150° C. and whose feeding speed was 10 mm/sec.

Thus a noncontact-reading type IC card receiving material according to the present invention was obtained on which the half tone images were recorded by the n-fold speed mode recording method and in which the recorded images were covered with a protective layer and the recorded images were subjected to the heat treatment.

Comparative Example 1

The procedures for preparation of the IC card receiving material and for recording of the images in Example 2 were repeated except that the ABS resin cover film was formed on the polyester film substrate including electric components by an injection molding method.

Thus a comparative noncontact-reading type IC card receiving material on which the half tone images were recorded by the one-time recording method was obtained.

Comparative Example 2

The procedures for preparation of the receiving material and for recording of the images in Example 6 were repeated except that the ABS resin cover film was formed on the polyester film substrate including electric components by an injection molding method.

Thus a comparative noncontact-reading type IC card receiving material on which the half tone images were recorded by the n-fold speed mode recording method was obtained.

The following items were evaluated for each IC card receiving material:

(1) Filtered Maximum Waviness Height WCM of IC Card Receiving Material (JIS B0610)

A waviness curve of the surface of each IC card receiving material under which an antenna was buried was obtained using a surface texture instrument, Surfcom 570A, manufactured by Tokyo Seimitsu Co., Ltd. Measuring conditions of the surface texture instrument; were as follows:

high-pass cut-off value : 0.08 mm reference length : 8 mm measuring speed : 0.03 mm/sec The filtered maximum waviness height was obtained from the waviness curve by the following method:

(a) the waviness curve is interposed by two lines each of which was parallel to the average line of the waviness curve and one of which included a maximum point of the waviness curve and the other of which included a minimum point of the waviness curve; and (b) calculating the distance between the two lines, which was the filtered maximum waviness height.

The measurement was repeated 10 times, and the measured values were averaged and the figure below the first place of decimals was omitted to obtain the averaged filtered maximum waviness height.

(2) White Spot (or White Line) and Unevenness in Recorded Image

Each recorded half tone images was visually observed to determine whether there was a white spot (or a white line) or unevenness in the recorded image.

(3) Camber of IC Card Receiving Material

Each IC receiving material was placed on a surface plate so that the card was oriented horizontally, and an amount of camber was measured with a thickness gage manufactured by Mitsutoyo Corp. whose measuring range was from 0 to 25 mm and whose minimum measuring unit was 0.01 mm.

(4) Feeding Property of IC Card Receiving Material

The feeding property of each IC card receiving material was evaluated with a card printing system, Artland Card Printing System, manufactured by Nisca Corp. The feeding property was classified as follows:

○: The feeding property was perfect.

Δ: The feeding speed became slow at times.

X : The card did not feed.

(5) Thermosensitivity of IC Card Receiving Material

Thermosensitivity was defined as the image density of the recorded half tone images of each receiving material.

The thermosensitivity was classified as follows:

○: The image density of each step of the recorded half tone images was almost the same as that of the image recorded on the receiving material obtained in Example 5.

◎: The image density of each step of the recorded half tone images was darker by one or more steps than that of the image recorded on the receiving material obtained in Example 5.

Δ: The image density of each step of the recorded half tone images was lighter by one or more steps than that of the image recorded on the receiving material obtained in Example 5.

(6) Light resistance of recorded image

A recorded image on each receiving material having an image density of about 1.0 (1.0±0.1) measured by Macbeth reflection densitometer RD918, was exposed to light for 24 hrs. using a xenon weathering tester manufactured by Shimazu Corp. The image density of the light irradiated image was measured. The resistance to light was defined as a remaining rate of the image density which is represented by the following equation:

remaining rate of image density (%)={(image density after the test)/(image density before the test)}×100

The light resistance of the recorded images was evaluated as follows:

◎: The remaining rate of the image density was greater than 70%.

○: The remaining rate of the image density was from 40 to 70%.

Δ: The remaining rate of the image density was less than 40%.

(7) Preservability of Recorded Image

Each recorded image was preserved in a chamber of 60° C. for 300 hours. The preservability of the recorded image was defined as the remaining rate of the image density which is obtained by the following equation:

remaining rate of image density (%)={(image density after the test)/(image density before the test)}×100

The preservability of the recorded image was evaluated as follows:

○: The remaining rate of the image density was from 85 to 115%.

X : The remaining rate of the image density was less than 85% or greater than 115%.

The results are shown in Table 1.

TABLE 1

| | WCM (μm) | white spot, unevenness *1 | camber (mm) | feeding property | thermosensitivity | light resistance | preservability |
|---|---|---|---|---|---|---|---|
| Example 1 | 6 | ΔW | 0.5 | Δ | Δ | X | X |
| Example 2 | 4 | ΔU | 0.3 | ○ | Δ | X | ○ |
| Example 3 | 5 | ΔU | 0.3 | ○ | Δ | X | ○ |
| Example 4 | 3 | ○ | 0.3 | ○ | ◎ | X | ○ |
| Example 5 | 3 | ○ | 0.3 | ○ | ○ | X | ○ |
| Example 6 | 3 | ○ | 0.3 | ○ | ◎ | X | ○ |
| Example 7 | 3 | ○ | 0.3 | ○ | ◎ | Δ | ○ |
| Example 8 | 3 | ○ | 0.3 | ○ | ◎ | ○ | X |
| Example 9 | 5 | ○ | 0.3 | ○ | ◎ | ○ | ○ |
| Example 10 | 3 | ○ | 0.3 | ○ | ◎ | ○ | ○ |
| Example 11 | 3 | ○ | 0.3 | ○ | ◎ | ◎ | ○ |
| Comparative Example 1 | 15 | XW | 1.2 | X | Δ | X | ○ |
| Comparative Example 2 | 11 | XW | 1.2 | X | ◎ | X | ○ |

*1: The evaluation of a white spot (or a white line) and unevenness in the recorded image is performed as follows:

○: There was no white spot (or no white line) nor uneven part in the recorded images.

ΔW: A faint white spot (or white line) was observed in the recorded images near the IC chip and the antenna.

ΔU: Faint unevenness was observed in the recorded images near the IC chip and the antenna.

XW: A large and clear white spot (or white line) was observed in the recorded images near the IC chip and the antenna.

The results in Table 1 clearly indicate that the receiving materials of the present invention exhibit such desirable characteristics as good image qualities and good thermosensitivity,, particularly, when the receiving material is made by the injection and compression molding method and has a porous intermediate layer. In addition, when the recorded image is covered with a protective layer, the recorded image has good light resistance.

Additional modifications and variations of the present invention are possible in light of the above teachings. It is therefore to be understood that within the scope of the appended claims the invention may be practiced other than as specially described herein.

This application is based on Japanese patent Publication No. 08-326129, filed on Nov. 21, 1996, the entire contents of which are herein incorporated by reference.

What is claimed is:

1. A noncontact-reading type IC card image receiving material useful for sublimation thermal transfer recording which comprises a substrate having opposed sides and comprising an IC chip and an antenna; a resin cover film formed overlying one side of said substrate and having a surface facing away from said substrate; and, optionally, a receiving layer formed overlying said cover film or overlying the other side of said substrate;

and in which an image is recorded on said cover film surface if said receiving layer is not present, or on said receiving layer if present, by imagewise heating a sublimation thermal transfer recording material comprising an ink layer which contacts the cover film surface if the receiving layer is not present, or the receiving layer if present, wherein the resin cover film is formed by an injection and compression molding method.

2. The noncontact-reading type IC card image receiving material of claim 1, wherein the resin cover film further comprises glass particles.

3. The noncontact-reading type IC card image receiving material of claim 1, including the receiving layer, and wherein the receiving material further comprises a porous intermediate layer between the resin cover film and the receiving layer.

4. The noncontact-reading type IC card image receiving material of claim 3, wherein the porous intermediate layer comprises hollow particles.

5. The noncontact-reading type IC card image receiving material of claim 3, wherein the porous intermediate layer comprises a resin film including air bubbles therein.

6. The noncontact-reading type IC card image receiving material of claim 3, wherein the ratio of specific gravity of the porous intermediate layer to specific gravity of the intermediate layer if the porous intermediate layer has no air bubble is less than about 0.7.

7. The noncontact-reading type IC card image receiving material of claim 1, including the receiving layer, and wherein the receiving layer further comprises at least one of an antioxidant, a photostabilizer and an ultraviolet absorbing agent.

8. The noncontact-reading type IC card image receiving material of claim 1, wherein the receiving material further comprises a protective layer which is formed overlying the image recorded on the cover film surface or the receiving layer and which comprises an ultraviolet absorbing agent.

9. The noncontact-reading type IC card image receiving material of claim 8, wherein the protective layer is formed overlying the image recorded on the cover film surface or the receiving layer by a thermal transfer recording method.

10. The noncontact-reading type IC card image receiving material of claim 8, wherein the protective layer is formed overlying the image recorded on the cover film surface or the receiving layer and adhered with an adhesive layer.

11. The noncontact-reading type IC card image receiving material of claim 10, wherein the adhesive layer comprises a resin having relatively low dye receivability.

12. The noncontact-reading type IC card image receiving material of claim 8, wherein the protective layer further comprises a resin having relatively low dye receivability.

13. The noncontact-reading type IC card image receiving material of claim 8, wherein the receiving material is subjected to heat treatment after the protective layer is formed thereon.

14. The noncontact-reading type IC card image receiving material of claim 1, wherein the receiving material is subjected to heat treatment after the image is recorded thereon.

15. The noncontact-reading type IC card image receiving material of claim 1, wherein filtered maximum waviness height of the cover film surface is not greater than about 10 $\mu$m.

16. The noncontact-reading type IC card image receiving material of Claim 1, wherein an amount of camber of the receiving material is not greater than about 1.0 mm.

17. A sublimation thermal transfer recording method comprising the steps of:

providing a sublimation thermal transfer recording medium which comprises an ink layer comprising a sublimable dye, and a noncontact-reading type IC card image receiving material which comprises a substrate having opposed sides and comprising an IC chip and an antenna, a resin cover film formed overlying one side of said substrate by an injection and compression molding method and having a surface facing away from said substrate, and, optionally, a receiving layer formed overlying said cover film or overlying the other side of said substrate; and recording an image on said cover film surface if said receiving layer is not present, or on said receiving layer if present, by imagewise heating the recording material whose ink layer contacts the cover film surface if the receiving layer is not present, or the receiving layer if present, to record an image thereon while each of the recording material and the receiving material feeds at a feeding speed, wherein the feeding speed of the recording material is slower than that of the receiving material.

18. The sublimation thermal transfer recording method of claim 17, wherein the resin cover film further comprises glass particles.

19. The sublimation thermal transfer recording method of claim 17, including the receiving layer, and wherein the receiving material further comprises a porous intermediate layer between the resin cover film and the receiving layer.

20. The sublimation thermal transfer recording method of claim 19, wherein the porous intermediate layer further comprises hollow particles.

21. The sublimation thermal transfer recording method of claim 19, wherein the porous intermediate layer comprises a resin film comprising air bubbles therein.

22. The sublimation thermal transfer recording method of claim 19, wherein the ratio of specific gravity of the intermediate layer to specific gravity of the intermediate layer if the porous intermediate layer has no bubble is less than about 0.7.

23. The sublimation thermal transfer recording method of claim 17, wherein the receiving layer further comprises at least one of an antioxidant, a photostabilizer and an ultraviolet absorbing agent.

24. The sublimation thermal transfer recording method of claim 17, wherein the receiving material further comprises a protective layer which is formed overlying the image recorded on the cover film surface or the receiving layer and which comprises an ultraviolet absorbing agent.

25. The sublimation thermal transfer recording method of claim 24, wherein the protective layer is formed overlying the image recorded on the cover film surface or the receiving layer by a thermal transfer recording method.

26. The sublimation thermal transfer recording method of claim 24, wherein the protective layer is formed overlying the recorded image on the cover film surface or the receiving layer and adhered with an adhesive layer.

27. The sublimation thermal transfer recording method of claim 26, wherein the adhesive layer comprises a resin having relatively low dye receivability.

28. The sublimation thermal transfer recording method of claim 24, wherein the protective layer, further comprises a resin having relatively low dye receivability.

29. The sublimation thermal transfer recording method of claim 24, wherein the sublimation thermal transfer recording method further comprises the step of heating the receiving material after the image is recorded thereon.

30. The sublimation thermal transfer recording method of claim 17, wherein the sublimation thermal transfer recording method further comprises the step of heating the receiving material after the image is recorded thereon.

31. The sublimation thermal transfer recording method of claim 17, wherein filtered maximum waviness height of the cover film surface is not greater than about 10 $\mu$m.

32. The sublimation thermal transfer recording method of claim 17, wherein an amount of camber of the receiving material is not greater than about 1.0 mm.

* * * * *